United States Patent [19]

Hebenstreit et al.

[11] 4,262,793

[45] Apr. 21, 1981

[54] ARRANGEMENT FOR COUNTING AND APPORTIONING OF ROD-SHAPED UNI-DIRECTIONALLY ORIENTED GOODS, IN PARTICULAR ELECTRODE RODS

[76] Inventors: Bertram Hebenstreit, Kapfenberg, Austria; Vereinigte Edelstahlwerke Aktiengesellschaft, 03, Vienna, Austria

[21] Appl. No.: 131,438

[22] Filed: Mar. 18, 1980

Related U.S. Application Data

[63] Continuation of Ser. No. 919,146, Jun. 26, 1978, abandoned.

[30] Foreign Application Priority Data

Jun. 25, 1977 [DE] Fed. Rep. of Germany ..... 2728733

[51] Int. Cl.[3] ..... B65G 47/26

[52] U.S. Cl. ..... 198/424; 198/431

[58] Field of Search ..... 198/431, 424, 418, 503, 198/480; 221/7, 10, 174; 414/47–49, 81, 745, 748

[56] References Cited

U.S. PATENT DOCUMENTS

| | | | |
|---|---|---|---|
| 3,089,885 | 3/1963 | Williamson | 414/49 X |
| 3,450,249 | 6/1969 | Poll | 198/431 |

*Primary Examiner*—Robert B. Reeves
*Assistant Examiner*—Douglas D. Watts
*Attorney, Agent, or Firm*—Werner W. Kleeman

[57] ABSTRACT

An arrangement for counting and apportioning uni-directionally arranged rod-like goods, such as electrode rods. The arrangement includes a horizontal driven conveyor belt which transports the electrode rods along a predetermined feed path thereof to a rod feeding end of the conveyor belt. A paddle wheel and curved guide member are mounted immediately underneath the rod feeding end of the conveyor belt and conjointly form a rod receiving compartment. A light barrier having a light emitting path extending across the conveyor belt emits a pulse each time a rod moves past the light emitting path. A belt conveyor having a plurality of equidistantly mounted rod receiving chambers mounted thereon is disposed immediately underneath the paddle wheel and moves in synchronism with the paddle wheel. A brake motor or equivalent structure is drivingly connected to the paddle wheel and operatively connected to the light barrier, so that when a predetermined number of pulses, representing a given portion of the rod-like goods to be counted, have been emitted by said light barrier in accordance with the number of rod-like goods moving past the light emitting path, the brake motor cyclically and stepwise advances the paddle wheel so that the last rod forming said given portion of rods is dropped from said rod feeding end between adjacent paddles just prior to the paddle wheel being rotatingly advanced or indexed by the brake motor.

9 Claims, 1 Drawing Figure

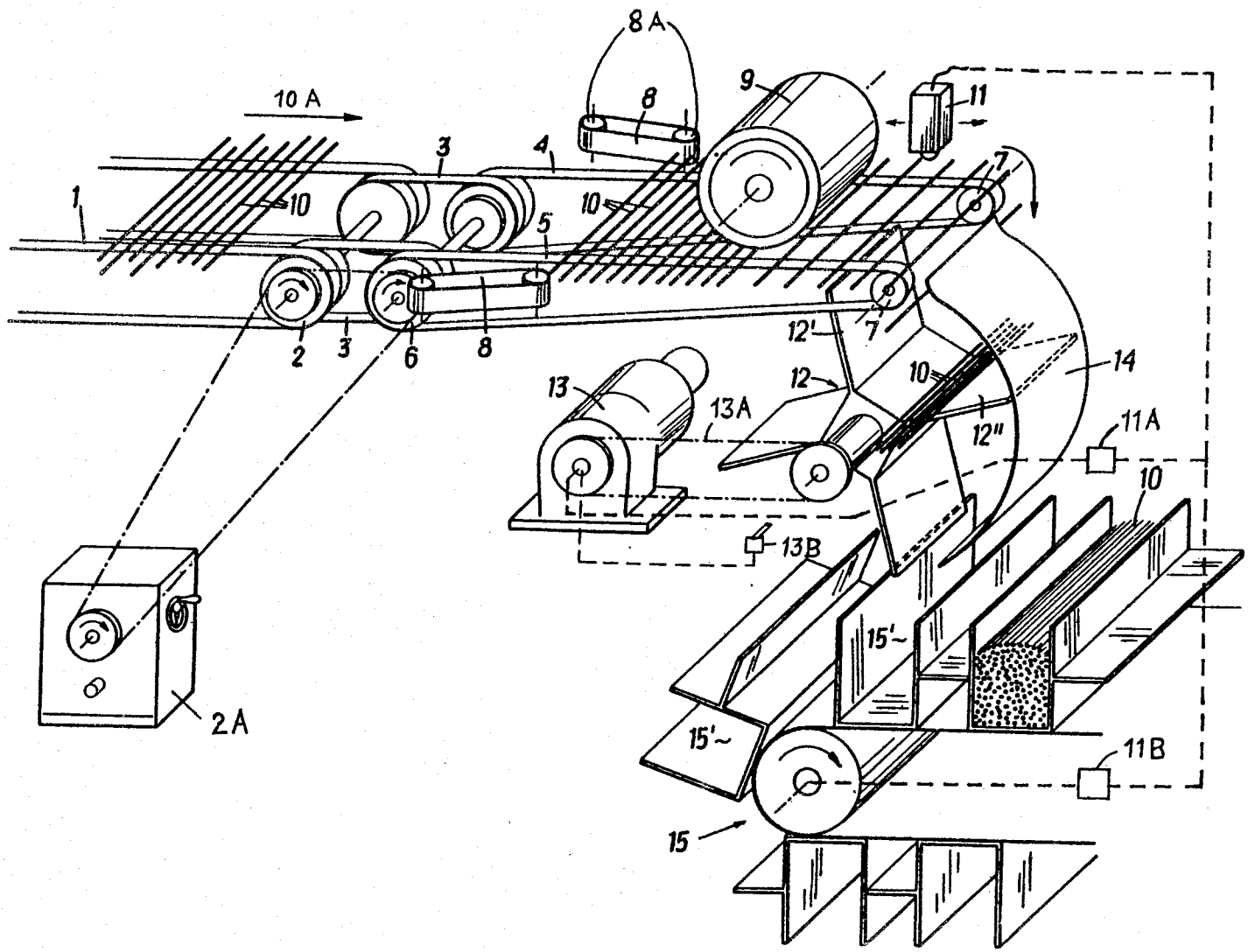
1
2
2A
3
3
4
5
6
7
7
8
8
8A
9
10
10
10
10A
11
11A
11B
12
12'
12''
13
13A
13B
14
15
15'
15'

ARRANGEMENT FOR COUNTING AND APPORTIONING OF ROD-SHAPED UNI-DIRECTIONALLY ORIENTED GOODS, IN PARTICULAR ELECTRODE RODS

CROSS REFERENCE TO RELATED CASE

This application is a continuation application of my commonly assigned, copending United States application Ser. No. 919,146, filed June 26, 1978, entitled "ARRANGEMENT FOR COUNTING AND APPORTIONING OF ROD-SHAPED UNI-DIRECTIONALLY ORIENTED GOODS, IN PARTICULAR ELECTRODE RODS", and now abandoned.

BACKGROUND OF THE INVENTION

The present invention relates to a new and improved arrangement for counting and apportioning of uni-directionally arranged rod-shaped goods or articles to be packaged, in particular electrode rods. The apportioning is carried out by means of a light barrier arranged across the feed path of a conveyor belt which emits an adjustable number of counting pulses to thereby control the feeding of the electrode rods.

Counting and apportioning arrangements of the aforedescribed type belong to the state-of-the-art. In such devices the separation of the counted portions is effected by flap-like separating walls, which, when swung over guide the falling rods alternately into adjacently arranged receiving chambers. A drawback of this known arrangement resides in that the counting as well as separation of the portions of rods is effected during the falling motion of the material to be packaged. In this known arrangement, on the one hand, the time for adjusting the separating walls when the predetermined number of rods to be packaged has been attained, is very brief, and on the other hand, such arrangement does also not always insure that the rod-shaped goods or materials to be packaged are maintained parallel to the separating walls during their falling motion. As a result, such an arrangement frequently malfunctions and there is obtained an imprecise apportionment of the numbers or pieces of the rod-shaped material, with the result that the inaccurate packaging is associated with additional cost factors. Such general type of prior art apparatus has been previously disclosed.

SUMMARY OF THE INVENTION

It is an important object of this invention to provide an arrangement for counting and apportioning of uni-directionally arranged rod-like goods to be packaged, in particular electrode rods, wherein the afore-described drawbacks of the prior art arrangements have been eliminated.

It is another object of the invention to provide such an arrangement which exactly apportions rod-like goods to be packaged and this arrangement carries out this function with a minimum of malfunction.

A further significant object of the present invention is to provide an improved arrangement for counting and apportioning of goods which are to be packaged, wherein the apportioning and separation of the last of the goods of a given portion is accomplished along the conveying or feed path of the infed goods, and then, in an extremely accurate, efficient and reliable manner.

The arrangement of the invention is characterized by a paddle wheel that, in a known manner, is axially parallelly mounted with respect to guide pulleys or the like for the conveyor belt. The paddle wheel importantly serves as a separating and apportioning means in that, the paddle wheel is arranged closely adjacent to and in coacting relationship with the conveyor belt, and particularly coacts with the feed path of the infed rod-like goods upon the conveyor belt. Specifically, during each separating and apportioning operation of the arrangement, one of the radial vanes or paddles of the rotatable paddle wheel is located in an upper or uppermost position, close to the conveyor belt, such that after a predetermined number of rod-like goods have been counted, this upper paddle wheel or vane can immediately move into the conveying path of the rod-like goods, arriving for instance in the form of so-to-speak an electrode blanket, to thus separate and apportion a predetermined portion or number of rod-like goods. In response to the predetermined counted number of rod-like goods such one radial vane, as mentioned, moves into the feed path of the electrode blanket reposing on the conveyor belt and positively separates and collects the counted portion of rod-like goods between adjacent paddle wheel vanes or paddles defining receiving compartments for the apportioned rod-like goods. Each receiving compartment between two adjacent paddle wheel vanes which have just received the counted portion of rod-like goods is bounded, for instance, by a curved guide member. Each of the thus collected portions of the rod-like goods is delivered at timed intervals into the buckets of a bucket chain or other suitable outfeed conveyor or the like. Each paddle wheel, indexing cycle, which is tripped by the last counting pulse, is operatively associated with a rotational movement of the paddle wheel which brings the next trailing vane or paddle of the paddle wheel into the starting position of the previous uppermost vane which was responsible for the separation of the prior portion of rod-like goods. The starting position of the paddle wheel is adjusted such that each last counted rod-like good of a portion of the rod-like goods, during rolling-off of the transport band, will just still be engaged by the uppermost vane or paddle of the compartment of the paddle wheel in which there are collected the last portion of the rod-like goods. Thus, as stated, the uppermost radial vane or paddle of the paddle wheel is always in a preparatory position so that, when the last counting pulse has signaled that a given portion of rod-like goods had been counted, such uppermost radial vane can immediately immerse into or engage with the feed path of the blanket of rod-like goods, i.e. here assumed to be the electrodes, and positively effects separation of the last of the rod-like goods of the counted portion.

In order to ensure that movement of the paddle wheel is controlled in such a manner, the light barrier emitting means (for example a photocell) is preferably adjustably mounted in the transport direction of the rod-like goods and its position is adjusted in accordance with the transporting velocity of the rod-like goods.

According to a preferred embodiment of the arrangment of the invention there is provided a driving roller along the path of the conveyor belt which serves to increase the distance of the transported rods on the conveyor belt by increasing the rotary motion of the rods. A further advantageous feature of the arrangement resides in that the paddle wheel is constructed so as to have four paddles or vanes and that the paddle wheel is driven by a brake motor.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing schematically illustrates in perspective view an arrangement for counting and apportioning goods or articles or the like in accordance with the invention.

DETAILED DESCRIPTION OF THE PREFERRED EMBODIMENTS

Describing now the drawing, the exemplary counting and apportioning arrangement or apparatus of the invention comprises two transport or conveyor belts 1 driven by a pair of guide pulleys 2 and a second pair of non-illustrated guide pulleys via driving motor 2A. As can be noted from the sole FIGURE, the rods 10 are transported by the conveyor belt 1 in the direction of the arrow 10A onto a second pair of intermediate conveyor belts 3 which are also driven by the pair of guide pulleys 2 and a further pair of guide pulleys 6, and then, onto a third pair of conveyor belts 4, 5 which are also driven by the pair of guide pulleys 6 and trained about a pair of idle pulleys 7. A pair of mirror-symmetrically laterally arranged conveyor belts 8 mounted at opposite sides of the feed or conveying path and driven by non-illustrated driving means around pairs of pulleys 8A serve to precisely orient the rods 10. In order to increase the distance between the rods during the counting step there is provided a driving roller 9 mounted over the conveyor belts 4 and 5 and driven by conventional non-illustrated driving means. The rods 10 pass a light barrier 11, preferably positioned in the region of the blank core ends of the electrode rods 10 and glide, after a counting step has been carried out, into the adjacent compartment defined by the paddles 12', 12'' and the curved guide member 14. This process continues until the last counting pulse, of a predetermined number of pulses emitted by the light barrier 11 and representing counted electrode rods forming the predetermined portion, causes a brake motor 13 or equivalent paddle wheel-indexing device to be placed into operation so as to stepwise rotate the paddle wheel 12. The paddle wheel 12, which is shown mounted axially parallel to the pulleys 6, 7 guiding the conveyor belts 4, 5, is indexed exactly through one cycle position. Since now the paddle wheel 12 is rotatingly advanced exactly one cycle position it thereby releases the previously counted number of rods forming a portion into a compartment 15' of the compartment chain or bucket chain 15 mounted below the paddle wheel 12.

Thus, the last counting pulse causes, via a relay 11A, the movement of the brake motor 13. The brake motor 13 is connected via a gear or chain 13A connected to the paddle wheel 12 which therefore is advanced exactly by 90°. A limit switch 13B which is adapted to be actuated by the paddles 12', 12'' thereafter causes the movement of the brake motor 13 to stop. The brake of the brake motor 13 ensures that the motor stops exactly and quickly at predetermined positions, thereby ensuring a concomitant stopping of the paddle wheel 12.

For sake of clarity and not to encumber the drawing with unnecessary details, the released rods 10 which are dropped into the compartment 15' have not been illustrated. However, the preceding compartment 15' of the compartment chain is illustrated with a number of stored rods 10.

In order to ensure that the compartment chain 15 only moves after a complete emptying of the rods from the compartment, defined by adjacent paddles 12', 12'' of the paddle wheel 12, the driving means for the compartment 15 is provided with a further adjustable relay 11B, which ensures that such driving means are energized after a certain time delay which is synchronized with the movement of the brake motor 13.

An important advantage of the arrangement of this invention resides in that the separating with the aid of the paddle wheel 12 is carried out at all times in the transporting direction of the goods to be packaged and along the feed path of the conveyor belt arrangement. The paddle wheel 12 can be rotated with the same velocity with which the rods 10 are moved over the conveyor belts 4 and 5. The paddles 12', 12'' appear from below between the to be separated rods without causing any kind of disturbances in the feeding operation. The arrangement of the invention provides for an enormous capacity increase and simultaneously a heretofore unattained counting precision for apportioning the rod-like material. This is particularly important when costly electrode rods form the material to be packaged and makes for a considerable saving. Heretofore, the imprecision in the number of rods being fed from the electrode manufacturing site into the distribution region for packaging the electrodes required an excess number of electrodes to be supplied in order to ensure that a minimum number is present in each package.

Although the invention is illustrated and described with reference to one preferred embodiment thereof, it is to be expressly understood that it is in no way limited to the disclosure of such a preferred embodiment, but is capable of numerous modifications within the scope of the appended claims.

What I claim is:

1. An arrangement for counting and apportioning of rod-like goods to be packaged, in particular electrode rods, comprising in combination:

substantially horizontally arranged conveyor belt means having a rod feeding end and adapted to transport rod-like goods along a predetermined conveying path to said rod feeding end;

a paddle wheel rotatably mounted below said conveyor belt means for coaction with said conveying path through which there are transported said rod-like goods on said conveyor belt means;

said paddle wheel having a plurality of paddles;

counting means operatively associated with said conveyor belt means for emitting a pulse each time a rod-like good moves past said counting means;

means for indexing said paddle wheel in response to a predetermined emitted pulse of said counting means in order to cyclically rotate said paddle wheel;

one of the paddles of said paddle wheel being located in a position immediately below the conveying path of said conveyor belt means in readiness for extending into said conveying path in response to said predetermined emitted counting pulse, in order to thereby move into said conveying path to carry out a separation function of the last counted rod-like good at said conveying path, of a predetermined portion of said rod-like goods, prior to said last counted rod-like good being released from said rod feeding end of said conveyor belt means; and means having at least one receiving compartment disposed beneath said paddle wheel for receiving the counted predetermined portion of rod-like goods.

2. The arrangement as defined in claim 1, wherein:

said counting means comprise light barrier means and including a light emitting path which extends across said conveyor belt means; and said light barrier means serving to emit a pulse each time a rod-like good moves past the light emitting path.

3. The arrangement as defined in claim 1, wherein:

said indexing means comprises a brake motor operatively connected to said paddle wheel and said light barrier means and adapted to cyclically rotate said paddle wheel.

4. The arrangement as defined in claim 1, wherein:

the outer periphery of said plurality of paddles describes a substantially circular path.

5. The arrangement as defined in claim 4, further including:

a guide member extending at least partially and in proximity to said circular path and substantially equidistantly therefrom from adjacent paddles of said paddle wheel for receiving therebetween and cyclically feeding the counted predetermined number of said rod-like goods.

6. The arrangement as defined in claim 1, further including:

a driving roll rotatably mounted above said conveyor belt means for placing the rod-like goods into an accelerated rotational movement.

7. The apparatus as defined in claim 1, wherein:

said paddle wheel comprises four paddles.

8. The apparatus as defined in claim 1, wherein:

said indexing means comprises a brake motor for indexing said paddle wheel to cyclically rotate the same.

9. An arrangement for counting and apportioning of articles to be packaged, comprising in combination:

substantially horizontally arranged conveyor belt means having an article feeding end and adapted to transport the goods along a predetermined conveying path to said article feeding end;

a paddle wheel rotatably mounted below said conveyor belt means for coaction with said conveying path through which there are transported said articles on said conveyor belt means;

said paddle wheel having a plurality of paddles the outer periphery of which describes a substantially circular path;

counting means operatively associated with said conveyor belt means for emitting a pulse each time an article moves past said counting means;

means for indexing said paddle wheel in response to a predetermined emitted pulse of said counting means in order to cyclically rotate said paddle wheel;

one of the paddles of said paddle wheel being located in an uppermost position immediately below the conveying path of said conveyor belt means in readiness for extending into said conveying path in response to said predetermined emitted counting pulse, in order to thereby engage into said conveying path to carry out a separation of the last counted article at said conveying path from the trailing articles on said conveying path prior to said last counted article being released from said article feeding end of said conveyor belt means; and means having a receiving compartment disposed beneath said paddle wheel for receiving a counted predetermined portion of the articles.

* * * * *